US005281941A

United States Patent [19]

Bernstein

[11] Patent Number: 5,281,941

[45] Date of Patent: Jan. 25, 1994

[54] COIL FORM AND COIL FOR ANTENNA COILS, OR THE LIKE

[76] Inventor: Elliot Bernstein, Ridge Rd., Glen Cove, N.Y. 11542

[21] Appl. No.: 744,923

[22] Filed: Aug. 14, 1991

[51] Int. Cl.[5] ..... H01F 27/28; H01F 27/30

[52] U.S. Cl. ..... 336/188; 336/208; 336/230; 343/867

[58] Field of Search ..... 336/188, 192, 199, 208, 336/230, ; 335/282, 289; 343/867, 788, 742

[56] References Cited

U.S. PATENT DOCUMENTS 2,425,304 8/1947 Combs ..... 336/208

*Primary Examiner*—Harold Broome

*Attorney, Agent, or Firm*—Ostrolenk, Faber, Gerb & Soffen

[57] ABSTRACT

A coil form for supporting coils of wire includes three intersecting orthogonal plates whose peripheral surfaces together define an imaginary spherical surface. The plate peripheries increase the effective winding area of the coils with respect to the exterior dimensions of the coil form. Terminal posts for the ends of the coil wires are positioned on the plates so as not to waste space and not to project beyond the imaginary sphere.

16 Claims, 2 Drawing Sheets

COIL FORM AND COIL FOR ANTENNA COILS, OR THE LIKE

BACKGROUND OF THE INVENTION

1. Field of the Invention

The present invention relates to a coil form for supporting coils of wire, for example, of an antenna coil, and to a coil. The antenna coil is useful for transmitting or receiving electronic signals.

2. Description of the Related Art

A known coil form 10 is illustrated in FIG. 1. The known coil form 10 is shaped like a cube having square sides 12, three of which are illustrated in FIG. 1. Three coils of wire (not illustrated) are wrapped in three orthogonal directions around the cubic coil form 10. Each coil is shaped like a square by the cube form. The coils overlap where they intersect.

Posts 16, which serve as terminal posts for the ends of the coils, extend outwardly from the corners 14 of the coil form 10. Since each wound coil has two ends, there are six posts 16. The wound coils and the coil form are usually disposed in an enclosure or housing. The known coil form 10 wastes space in the enclosure because the posts 12 extend outward from the corners 16 and this must be accommodated in the enclosure, which reduces the maximum cross-section for the coil in any size enclosure.

In general, the effective winding area of a coil of wire is the product of the number of turns of wire within the coil multiplied by the area surrounded by the coil. When the number of turns is selected, the effective winding area of a coil is only a function of its area. Thus, when the greatest exterior dimensions of a coil (i.e., its overall width) cannot be changed, and when the number of turns cannot be changed, the effective winding area of the coil is determined by its shape.

The square shape of the coils supported by the known coil form 10 is disadvantageous because it limits the effective winding area of the coils, with respect to the greatest external dimensions of the coil form 10 (i.e., the distance between opposite corners 14), in any enclosure.

SUMMARY OF THE INVENTION

The present invention maximizes the effective winding area with respect to the overall width of a coil form. Space within an enclosure in which the coil form is disposed is not wasted. Furthermore, an antenna can be efficiently assembled using a coil wrapped on the coil form, according to the present invention.

A coil form of the present invention includes supporting means for supporting three overlapping, intersecting, preferably mutually orthogonal, coils of wire. The supporting means together define an imaginary, rounded three-dimensional surface, particularly a sphere. The coil form includes terminal posts for the terminating ends of the coils of wire. The terminal posts are supported to the supporting means. The terminal posts are preferably so placed and of a size as to be located within the imaginary, rounded three-dimensional surface and so as to not project beyond it, meaning that the maximum width of the wound coil is determined by the coils, not by the terminal posts.

More particularly, the coil form includes: first, second and third intersecting, preferably mutually orthogonal, same diameter circular plates. The plates intersect so that each plate is symmetrical. Each plate has a rounded, and particularly circular, peripheral support surface for supporting a respective one of first, second and third coils of wire. The coils intersect and overlap where the plates intersect. Each of the support surfaces includes parallel spaced apart ridges for positioning the respective coil of wire between the ridges.

The support surfaces together define an imaginary, rounded three-dimensional surface, and particularly a sphere.

The plates intersect each other so as to define eight three-dimensional sectors. Each sector is bounded by a quadrant sector of each of the three plates. Each terminal post for each terminating end of a coil of wire is connected to one plate. Each terminal post is so located within one of the three-dimensional sectors and is so sized as to avoid projecting radially outward of the plate peripheries. Each post is located within a different respective sector.

Preferably, the plates have flat opposite sides, their peripheral support surfaces are circular, the plates orthogonally intersect each other, the rounded three-dimensional surface defined by the support surfaces is spherical, and the sectors are bounded by generally pie-shaped quadrants of the sides of all three plates.

The present invention has particular application to an antenna coil, and that antenna coil includes the coil form and the coils of wire positioned around the support plates of the coil form.

Other features and advantages of the present invention will become apparent from the following description of preferred embodiments of the invention, with reference to the accompanying drawings.

DETAILED DESCRIPTION OF THE PREFERRED EMBODIMENTS

Figure 1:
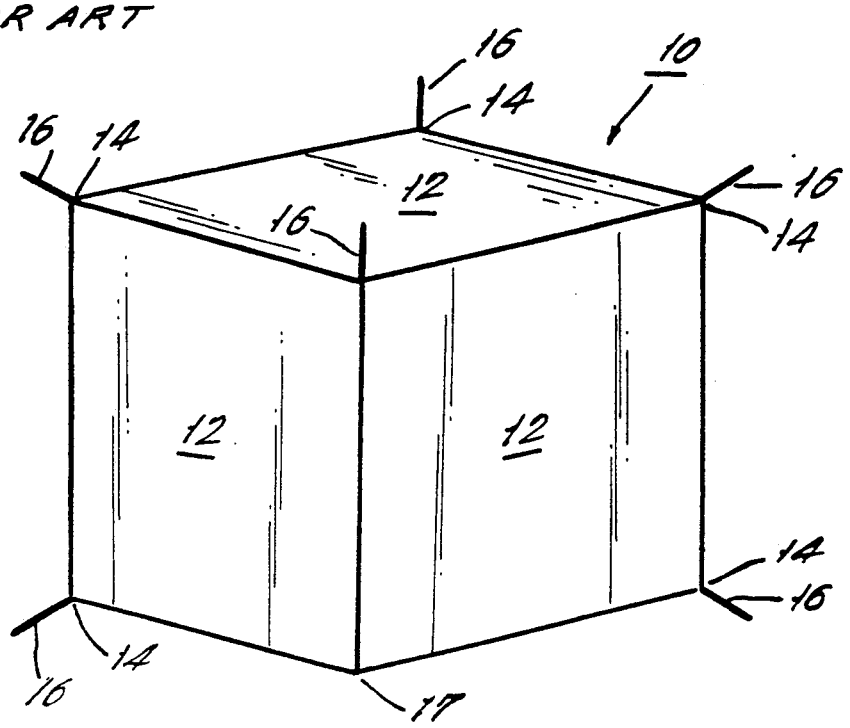
FIG. 1 PRIOR ART
FIG. 1 is a perspective view of a coil form in accordance with the prior art.
Figure 2:
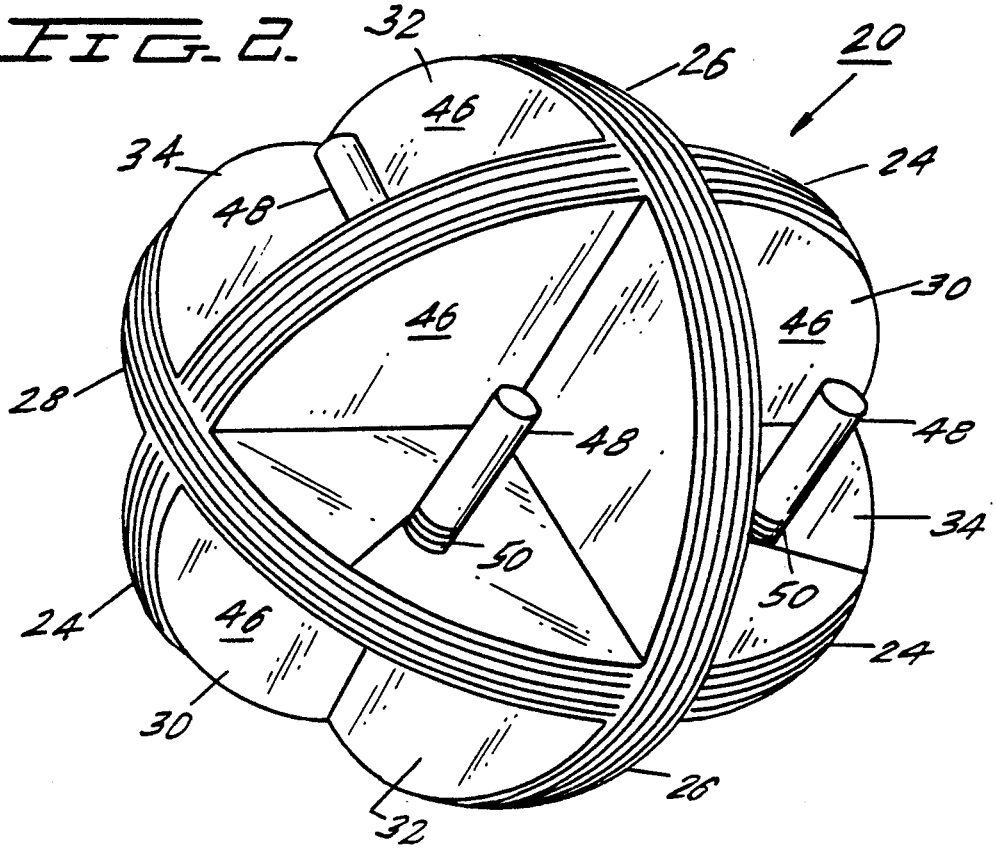
FIG. 2 is a perspective view of an antenna coil with coils of wire supported on a coil form in accordance with the invention.

Referring to the drawings, FIG. 2 shows an antenna coil 20 according to the present invention. The antenna coil 20 includes a coil form 22 (FIG. 3) and three coils of wire 24, 26 and 28 (FIG. 2) supported thereon.

The coil form 22 includes three same size and shape plates 30, 32 and 34 which orthogonally intersect each other, and each plate is symmetrical. The plates 30, 32 and 34 are relatively thin between their flat opposite sides. (Only three of those sides, one for each plate, can be seen in the drawings.) The plates 30, 32 and 34 have respective circular peripheral surfaces 36, 38 and 40. Respective electrically conductive wire coils 24, 26 and 28 are wound around and are supported on the peripheral surfaces 36, 38 and 40.

The circular peripheral surfaces 36, 38 and 40 of the plates 30, 32 and 34 define an imaginary rounded, and particularly spherical exterior surface. Since the peripheral surfaces 36, 38 and 40 are circular, the effective winding area of the wire coils 24, 26 and 28 is maximized, with respect to the greatest overall dimension or width of the coil form 22, at the diameter of the spherical surface.

Figure 3:
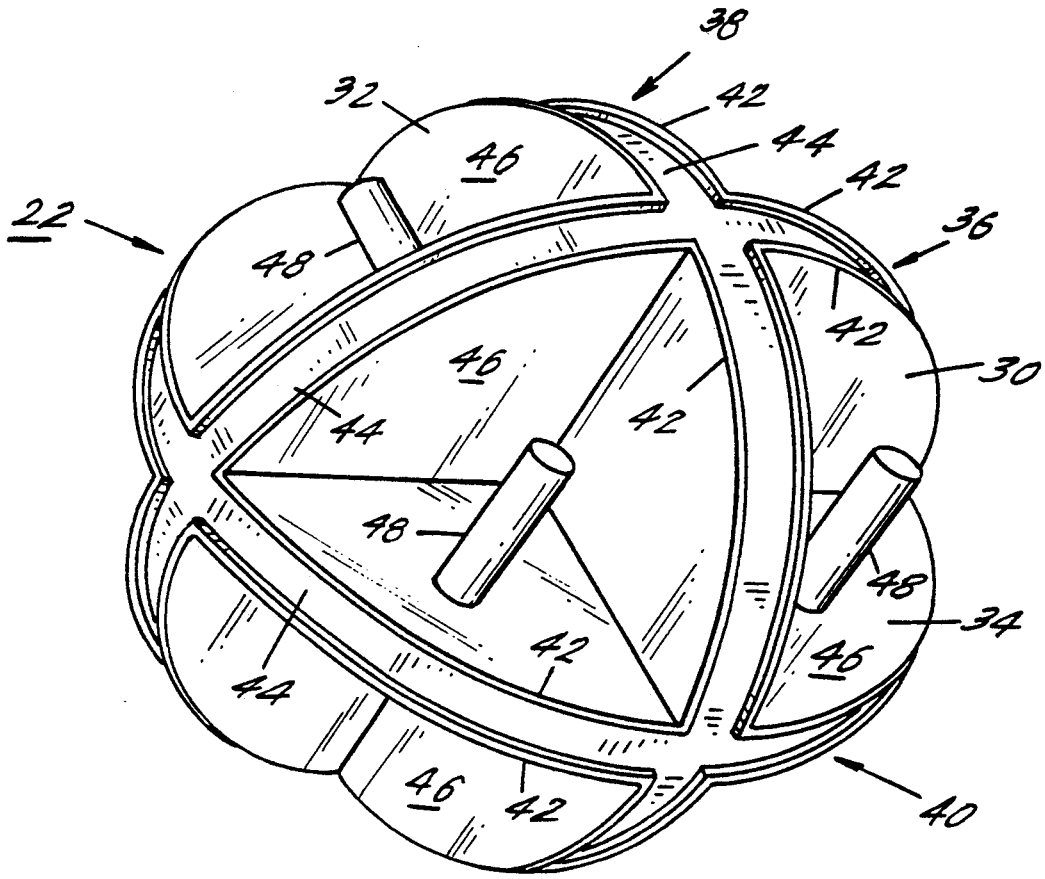
FIG. 3 is a perspective view of the coil form of FIG. 2, without the coils.

As illustrated in FIG. 3, each of the peripheral surfaces 36, 38 and 40 includes a respective pair of upstanding parallel ridges 42 which define a respective groove 44 therebetween. Each coil of wire 24, 26 and 28 is held in place and supported within the groove 44 at its respective peripheral surface.

Eight three-sided, spherical sectors 46 (only one of which can be seen in its entirety in the drawings) are defined within the coil form 22. The sides of each sector 46 are formed by pie-shaped portions of the flat sides of all three plates 30, 32 and 34.

There are three pairs of terminal posts 48. Each pair of posts terminates the opposite ends 50 of a respective one of the three coils of wire 24, 26 and 28. The ends 50 (only three of which are illustrated in the drawings) are wrapped around or tied to the respective posts 48 to hold the ends 50 and the respective coils 24, 26 and 28 in place. Each post 48 extends perpendicularly out from the side of one of the plates 30, 32 and 34. Each post lies entirely within its respective sector 46 and is of a length to not project radially out beyond the imaginary sphere defined by the coil form. As a result, the posts 48 would not waste valuable space inside an enclosure or housing for the coil.

Although the present invention has been described in connection with particular embodiments thereof, many other variations and modifications and other uses will become apparent to those skilled in the art. It is preferred, therefore, that the present invention be limited not by the specific disclosure herein, but only by the appended claims.

What is claimed is:

1. A coil form for a plurality of wire coils, comprising:

(A) supporting means for supporting three intersecting wound coils of wire, the supporting means being shaped for together defining an imaginary rounded three-dimensional surface; and (B) terminals for terminating ends of the coils of wire, said terminals being connected to said supporting means, said terminals being located within the rounded three-dimensional surface.

2. A coil form for a plurality of wire coils, comprising:

(A) first, second and third plates, each of said plates having a rounded peripheral support surface for supporting a respective one of intersecting first, second and third coils of wire, said support surfaces being shaped for defining an imaginary rounded three-dimensional surface, said plates intersecting each other so as to define a plurality of three-dimensional sectors each of which is bounded by the imaginary rounded three-dimensional surface; and (B) terminal posts for terminating ends of the coils of wire, each said terminal post being connected to one of said plates, each said terminal post being located within one of said three-dimensional sectors.

3. The coil form of claim 2, wherein each said plate has opposite sides which extend to the respective said support surface of each said plate.

4. The coil form of claim 3, wherein said plate opposite sides are flat.

5. The coil form of claim 3, wherein said peripheral support surfaces are circular.

6. The coil form of claim 5, wherein said plates orthogonally intersect each other.

7. The coil form of claim 6, wherein said imaginary rounded three-dimensional surface defined by said peripheral support surfaces is spherical.

8. The coil form of claim 2, wherein said plates orthogonally intersect each other.

9. The coil form of claim 8, wherein said imaginary rounded three-dimensional surface defined by said peripheral support surfaces is spherical.

10. The coil form of claim 2, wherein each said peripheral support surface includes spaced apart ridges thereon for positioning the coil of wire on that said plate.

11. The coil form of claim 2, wherein each said terminal post is of a length above said plate on which said post is disposed to be located entirely within the respective said sector and not project beyond said imaginary surface.

12. The coil form of claim 11, wherein each of said posts is located within a different one of said sectors.

13. In combination, a coil form for a plurality of wire coils, comprising:

(A) first, second and third plates, each of said plates having a rounded peripheral support surface for supporting a respective one of intersecting first, second and third coils of wire, said support surfaces being shaped for defining an imaginary rounded three-dimensional surface, said plates intersecting each other so as to define a plurality of three-dimensional sectors each of which is bounded by the imaginary rounded three-dimensional surface; and (B) terminal posts for terminating ends of the coils of wire, each said terminal post being connected to one of said plates, each said terminal post being located within one of said three-dimensional sectors; and intersecting first, second and third coils of wire supported on said peripheral support surfaces of said first, second and third plates, respectively; each said coil having opposite ends and each of said ends being secured to a respective said terminal post.

14. The combination of claim 13, wherein said plates have opposite sides, said peripheral support surfaces are circular, said plates orthogonally intersect each other, and said imaginary rounded three-dimensional surface defined by said support surfaces is spherical.

15. The combination of claim 13, wherein each said support surface includes spaced apart ridges, and each said coil of wire is positioned between said ridges of its said support surface.

16. The combination of claim 13, wherein each said terminal post is of a length above the said plate on which said post is disposed to be located entirely within the respective said sector, and each said post is located within a respective different one of said sectors.

* * * * *